United States Patent [19]

Mastroianni

[11] Patent Number: 4,770,079

[45] Date of Patent: Sep. 13, 1988

[54] COLLAPSIBLE STRINGED MUSICAL INSTRUMENT

[76] Inventor: Joseph C. Mastroianni, 2051 Cliff Dr., Apt. 20, Santa Barbara, Calif. 93109

[21] Appl. No.: 87,047

[22] Filed: Aug. 19, 1987

Related U.S. Application Data

[63] Continuation of Ser. No. 830,118, Feb. 18, 1986, abandoned.

[51] Int. Cl.[4] ..... G10D 3/18

[52] U.S. Cl. ..... 84/291; 84/267; 84/327

[58] Field of Search ..... 84/267, 291, 293, 327

[56] References Cited

U.S. PATENT DOCUMENTS

| | | | |
|---|---|---|---|
| 514,877 | 2/1894 | Back | 84/293 X |
| 774,750 | 11/1904 | Gladieux | 84/327 X |
| 2,884,828 | 5/1959 | Montenare | 84/327 |
| 3,413,883 | 12/1968 | Helbourne | 84/267 |
| 3,910,151 | 10/1975 | Copeland | 84/267 |
| 3,911,778 | 10/1975 | Martin | 84/267 |
| 4,235,143 | 11/1980 | Hoexter | 84/1.16 |
| 4,592,265 | 6/1986 | Steinberger | 84/327 |
| 4,632,002 | 12/1986 | Clevinger | 84/1.16 |
| 4,638,708 | 1/1987 | Kamal | 84/293 |
| 4,686,882 | 8/1987 | Shaw | 84/291 |

*Primary Examiner*—Lawrence R. Franklin

*Attorney, Agent, or Firm*—Amster, Rothstein & Ebenstein

[57] ABSTRACT

A collapsible stringed musical instrument having an elongated body with a coupling portion at one end, a string bridge portion at the other end, a playing face and an opposite back face. A neck is provided with a coupling portion at one end and a string peg portion at the other end. The coupling portion of the neck is adapted to mate with the coupling portion of the body. A plurality of supports are pivotably affixed at one end to the back face of the body. The supports pivot from a closed position in which they are substantially situated within the outline of the elongated body to an open position in which they substantially extend beyond such outline.

7 Claims, 4 Drawing Sheets

10
12
14
16a
16b
16c
16d
24
26
28
30
34
36
38
40
46
48
50
52
54
56
60
62
92
98
108

14
28
106
102
98
96
92
44
108

44
94
96
92

74
90
71
70
78a
78b
80
72
88
76b
76a
69
68

88
71
16b
70
90
74
16a
80
82
84a
69
84b
72
68
88
56
58a
58b
66c
66a
66b

COLLAPSIBLE STRINGED MUSICAL INSTRUMENT

This is a continuation of co-pending application Ser. No. 830,118 filed on Feb. 18, 1986, now abandoned.

BACKGROUND OF THE INVENTION

This invention relates to a collapsible stringed musical instrument. In particular, this invention relates to a collapsible guitar and finds particular use as a practice instrument for guitar students which may be conveniently packed for travel. The guitar includes an elongated body having four pivotable supports which in their open position approximate the support areas of a full size classical guitar. The guitar has a neck which may be conveniently coupled to and uncoupled from the elongated body.

Collapsible or foldable stringed musical instruments, including guitars, have been known in the past. For example, U.S. Pat. Nos. 4,191,085 to Latwin, 4,201,108 to Bunker, 3,204,510 to Hopf, 4,073,211 to Jorgensen, 350,693 to Mustil and Des. 249,387 to Hart, each disclose various stringed musical instrument structures which are collapsible, foldable or have removable parts. However, none of these prior instruments provides a structure having supports which are pivotedly affixed to an elongated body and a neck which may be coupled or uncoupled to the body. Thus none of the prior structures successfully provides an instrument which may conveniently collapse for ease of packing in travel and opened to form an instrument having support areas which approximate a full size instrument.

SUMMARY OF THE INVENTION

The present invention overcomes the disadvantages associated with prior collapsible or foldable musical stringed instruments. Accordingly, it is an object of this invention to provide a collapsible musical stringed instrument that may be easily packed for travel in its closed state and easily opened to approximate the size and support areas of a standard stringed instrument.

It is a further object of this invention to provide a collapsible guitar which is particularly suitable as a practice instrument and may be easily packed for travel in its closed state and easily opened to approximate the size and support areas of a standard classical guitar.

It is still a further object of this invention to provide a collapsible guitar having an elongated body with four pivotable supports which, when open, approximate the support areas of a standard classical guitar and a neck which may be readily coupled to and uncoupled from the body.

In accordance with the present invention, there is provided an elongated body having a coupling position at one end, a string bridge portion at the other end, a playing face and a back face. A neck is provided with a coupling portion at one end and a string peg portion at the other end. The coupling portion of the neck is adapted to mate with the coupling portion of the body. A plurality of supports are pivotably attached to the back face of the body so that when they are in their open position they approximate the support areas of a standard classical guitar. The supports and body have lock washers which permit the supports to be locked in a selection of predetermined open positions.

BRIEF DESCRIPTION OF THE DRAWINGS

The above objects, aspects and advantages of the invention, as well as others, will be apparent from the detailed description of the preferred embodiment of the invention considered in conjunction with the drawings which should be considered in an illustrative and not in a limiting sense, as follows.

DETAILED DESCRIPTION OF THE DRAWINGS

Figures 1, 2:
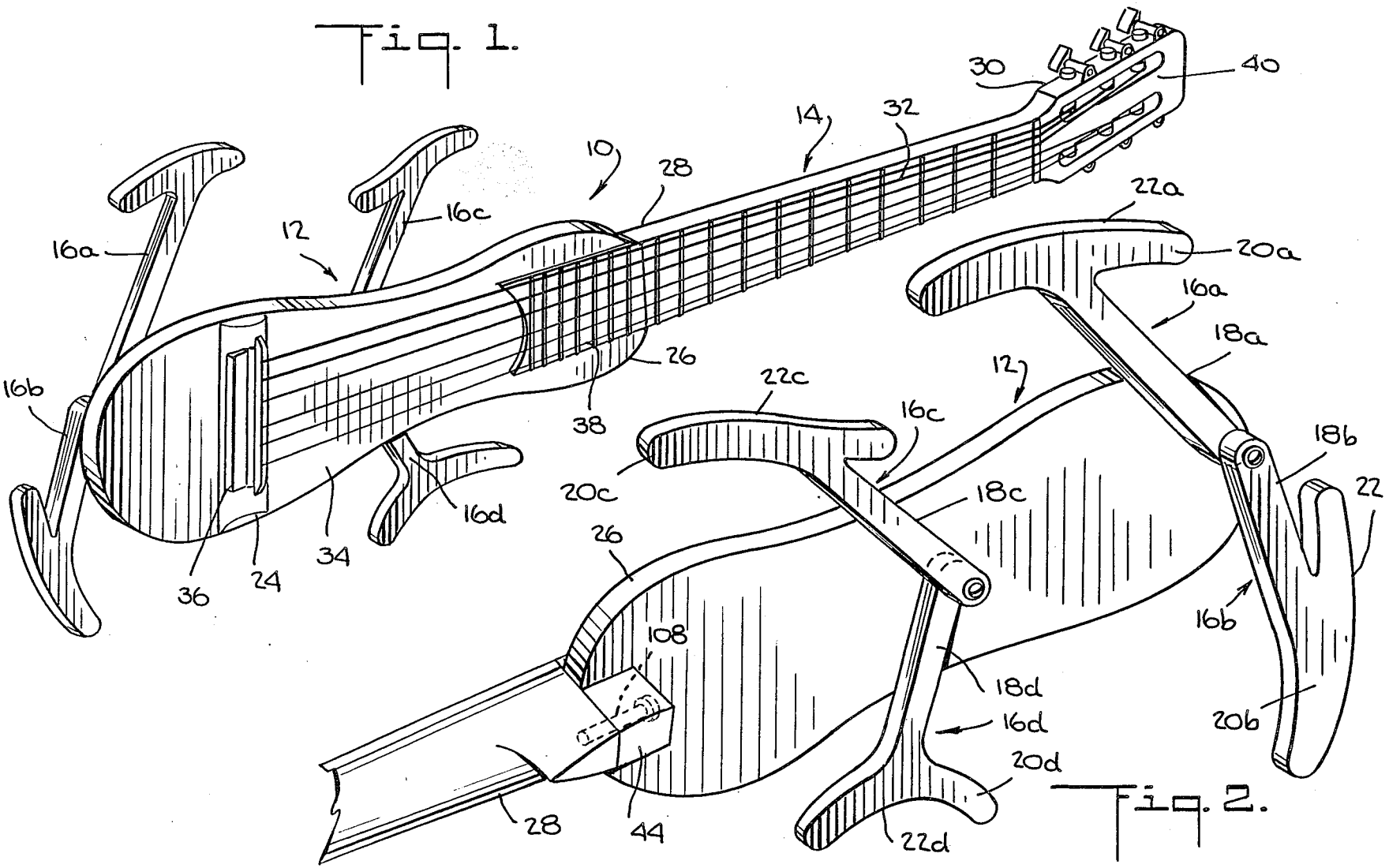
FIG. 1 is a perspective view generally showing the front of the collapsible stringed musical instrument in a fully opened condition.
FIG. 2 is a perspective view generally showing the rear of the collapsible stringed musical instrument of FIG. 1.

As seen in FIG. 1, the collapsible stringed musical instrument 10 has a body 12, a neck 14 and four body simulating supports 16*a*, 16*b*, 16*c* and 16*d* which generally approximate the support areas of a standard size instrument. The body 12 is elongated in shape and has a string bridge portion 24 at one end and a coupling portion 26 at the other end. The neck 14 has a coupling portion 28 at one end and a string peg portion 30 at the other end. A fret board 32 forms the playing face of the neck. The playing face 34 of the body 12 has a conventional string bridge 36 affixed in its string bridge portion 24 and a fret board extension 38 affixed in its coupling portion 26. The string peg portion 30 of the neck 14 includes a conventional peg head 40. The relative spacing between the peg head 40 and the string bridge 36 is conventional.

As seen in FIG. 2, the supports 16*a*, 16*b*, 16*c* and 16*d* are pivotably affixed to the rear face 42 of the body 12. The neck 14 is removably attached to the body 12 by a coupling assembly 44 provided on the rear face 42 of the coupling portion 26 of the body 12. Each of the supports 16*a*, 16*b*, 16*c* and 16*d* has a radial arm portion 18*a*, 18*b*, 18*c* and 18*d*, respectively, and a brace portion 20*a*, 20*b*, 20*c* and 20*d*, respectively.

Figures 3, 4:
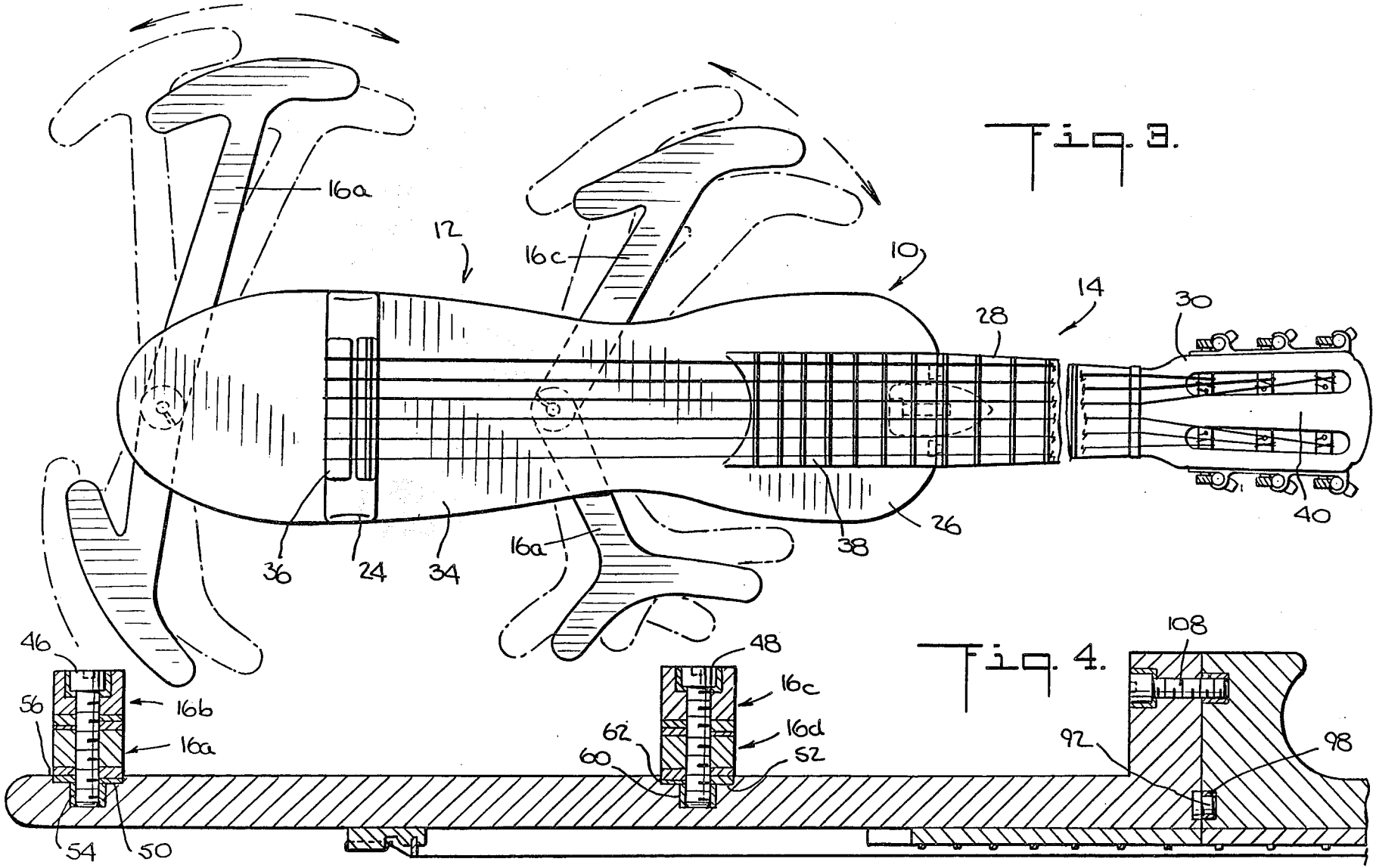
FIG. 3 is a plan view of the collapsible stringed musical instrument showing the pivoting movement of the supports in phantom.
FIG. 4 is a partial section of the collapsible stringed musical instrument of FIG. 3.
Figures 5, 8, 9, 10:
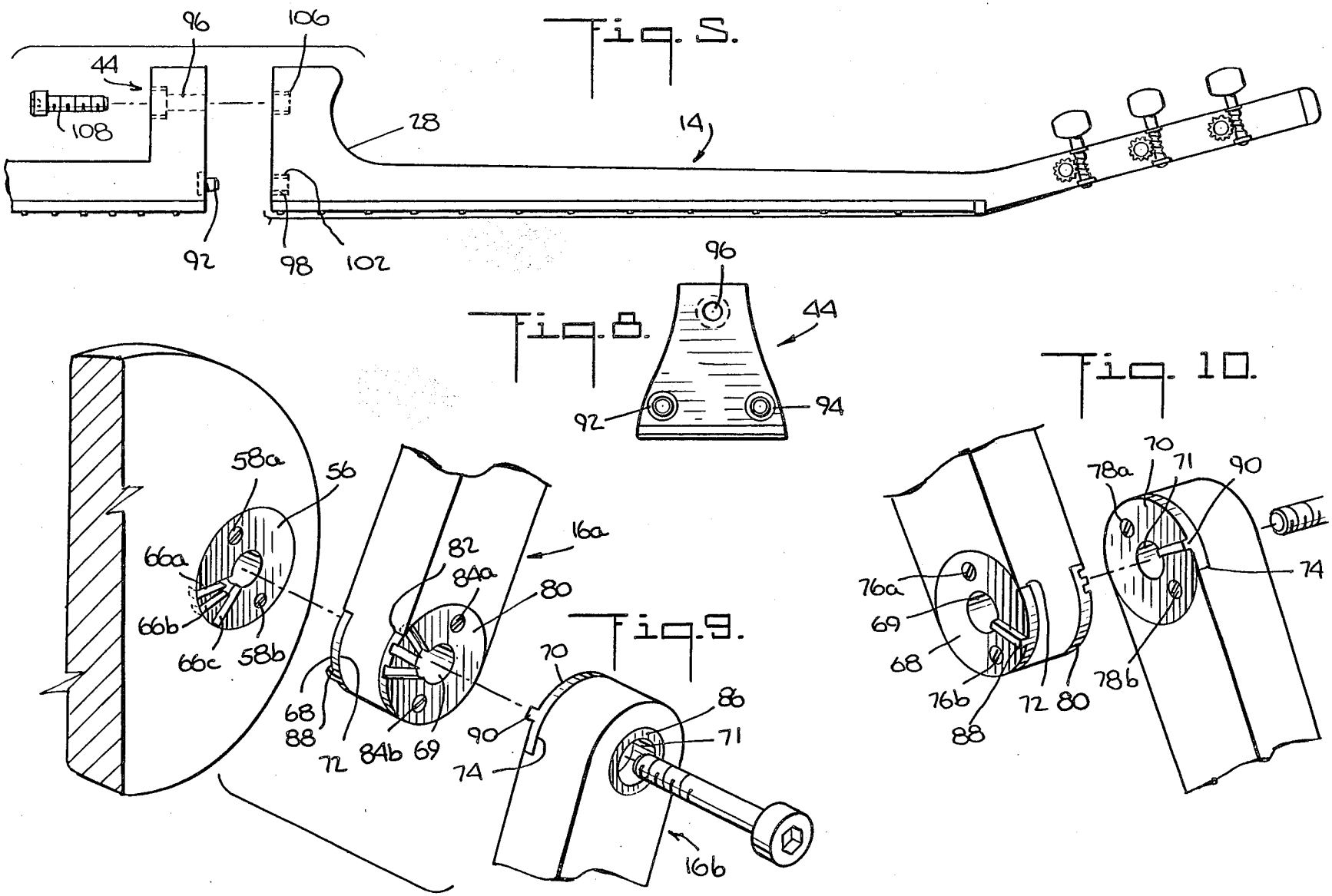
FIG. 5 is an exploded elevational view of the neck and coupling portion of the body of the collapsible stringed musical instrument.
FIG. 8 is an elevational view of the coupling portion of the body of the collapsible stringed musical instrument.
FIG. 9 is an exploded perspective view generally showing from the rear, the lock washers of two of the pivotable supports and the body of the collapsible stringed musical instrument.
FIG. 10 is a perspective view generally showing from the front, the lock washers of the supports of FIG. 9.

As seen in FIGS. 4, 9 and 10, the supports 16*a* and 16*b* are pivotably affixed, as a pair, to the rear face 42 of the body 12 by a single screw 46. The supports 16c and 16d are pivotably affixed, as a pair, to the rear face 42 of the body 12 by a single screw 48. The body is provided with countersink bores 50 and 52, opening towards the rear face 42 thereof. A screw socket 54 and concentric annular female lock washer 56 are fitted within countersink bore 50 and retained by a pair of screws 58a and 58b. An identical screw socket 60 and concentric annular female lock washer 62 are fitted within the countersink bore 52 and retained by a pair of screws (not shown). Each annular female lock washer 56 and 62 are provided with three radial slots 66a, 66b and 66c.

FIGS. 9 and 10 show in detail the pivot structures of supports 16a and 16b. The supports 16c and 16d, have identical pivot structures. The supports 16a and 16b are provided with annular male lock washers 68 and 70 which are fitted within ledges 72 and 74 formed in the supports 16a and 16b and held by screw pairs 76a and 76b and 78a and 78b, respectively. The annular male lock washers 68 and 70 are concentric with bores 69 and 71 formed in the supports 16a and 16b, respectively. The support 16a is also provided with an annular female lock washer 80 which is identical to annular female lock washers 56 and 62 and is concentric with bore 69. The annular female lock washer 80 is fitted in a ledge 82 formed in the support 16a and held by a pair of screws 84a and 84b. The support 16b has an annular bushing 86 which is fitted within the support 16b concentric with bore 71. The annular male lock washers 68 and 70 are provided with tabs 88 and 90, respectively, which are sized to selectively engage the radial slots 66a, 66b and 66c of the annular female lock washers 56 and 80, respectively.

As seen in FIGS. 4, 5, 7 and 8 the coupling assembly 44 is provided with a pair of male coupling pins 92 and 94 and a countersink bore 96. The coupling portion 28 of the neck 14 is provided with a pair of female sockets 98 and 100, fitted within bores 102 and 104 and a screw nut 106, fitted within bore 106. The coupling assembly 44 is aligned with the coupling portion 28 of the neck 14 by the interfit of the male coupling pins 92 and 94 with the female sockets 98 and 100. A screw 108 passes through the countersink bore 96 of the coupling assembly 44 and engages the screw nut 106. When the screw 108 is tightened it securely holds the neck 14 to the coupling assembly 44 of body 12.

As seen in FIGS. 1 and 2 the brace portions 20a, 20b and 20c of supports 16a, 16b and 16c, respectively, have convex arched surfaces 22a, 22b and 22c. The brace portion 20d of support 16d has a concave arched surface 22d.

Figure 6:
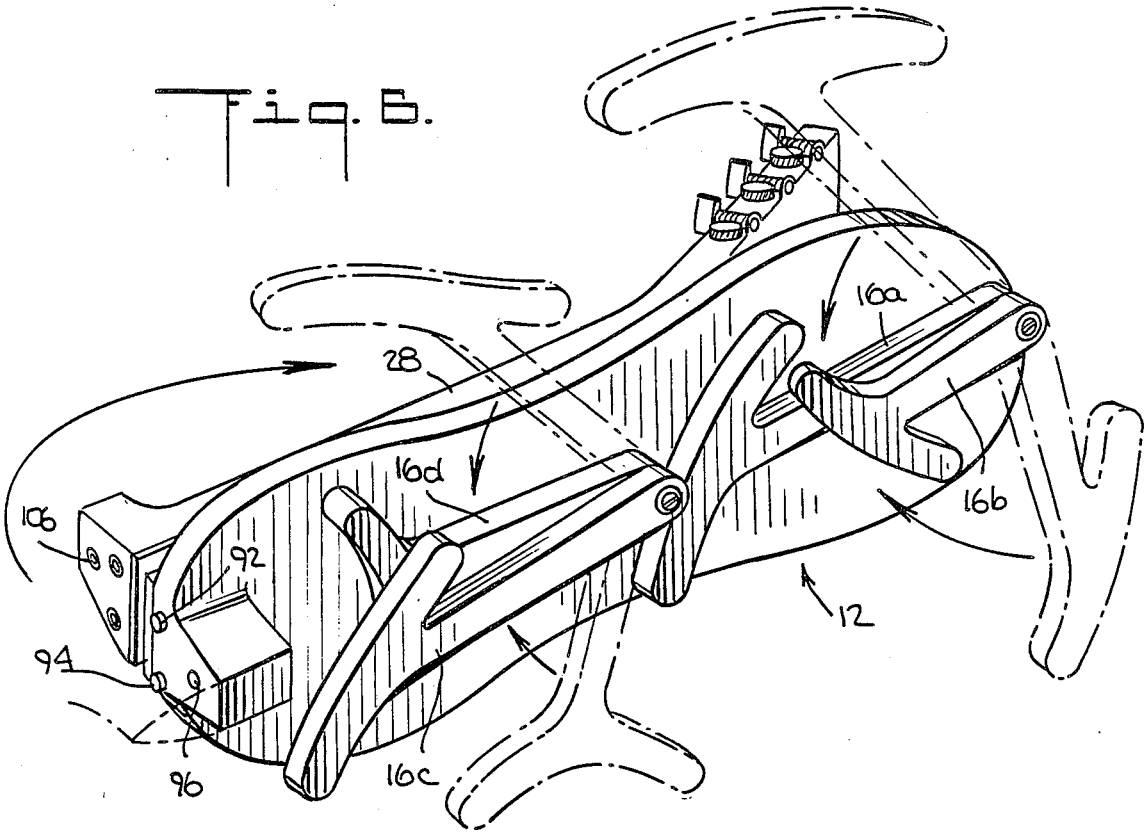
FIG. 6 is a perspective view generally showing the rear of the collapsible stringed musical instrument in its collapsed condition and showing, in phantom, its open position.
Figure 7:
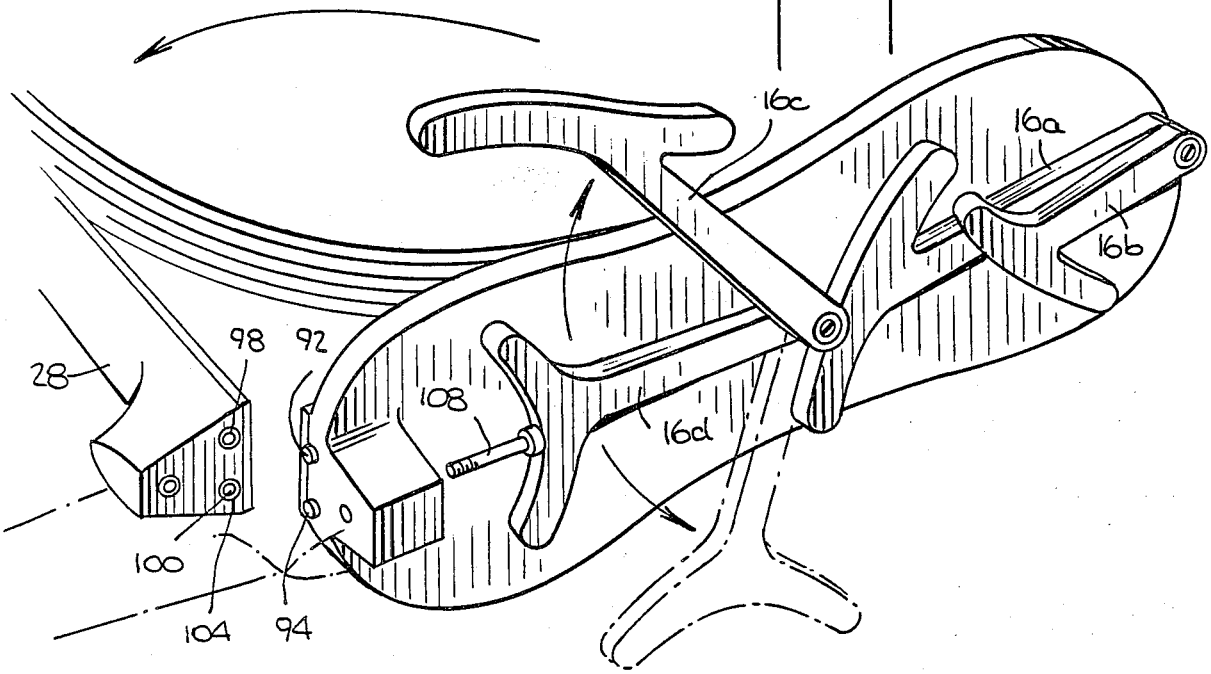
FIG. 7 is a perspective view generally showing the rear of the collapsible stringed musical instrument in a partially open position and showing, in phantom, a fully open position.

As seen in FIG. 6, when the collapsible stringed musical instrument 10 is in its collapsed position, the neck 14 is detached from the body 12 and the supports 16a, 16b, 16c and 16d are pivoted so that they lie within the outline of the body 12. Since the neck 14 and body 12 are of approximately the same length, and since the neck has a smaller width than the body, when the collapsible stringed musical instrument is in its collapsed position, the neck is capable of being situated substantially within the outline of the elongated body, and they may be easily packed for travel. To open the collapsible stringed musical instrument the supports 16a, 16b, 16c and 16d are pivoted to an open position so that the selected slots and tabs of their respective lock washers engage and the screws 46 and 48 are tightened. The neck 14 is attached to the elongated body 12 by screw 108. As is seen in FIG. 1, when the collapsible stringed musical instrument 10 is in an open position, the supports 16a, 16b, 16c and 16d, generally approximate the support areas of a standard instrument by simulating the outline or body size of a standard size instrument. In this way a user of the instrument 10 is provided with the "feel" of a full bodied instrument such that it can comfortably support the user's arm, comfortably rest on the user's chest, and comfortably allow placement on either of the user's legs.

The sound produced by the collapsible stringed musical instrument 10 is substantially softer, i.e., lower in volume, than a standard instrument with a resonant sounding board. Accordingly, the collapsible stringed musical instrument 10 is particularly suitable for use as a practice instrument. However, a conventional electrical pick-up may be used, in conjunction with an amplifier and loud speaker, to produce amplified sound.

It should be understood that the embodiment described herein is only illustrative of the present invention. It should be recognized by those skilled in the art that a latitude of modification, change, and substitution is intended in the foregoing disclosure. For example, snap couplings can be used instead of screws to connect the neck and supports with the body. Further, the string bridge may be provided with a spring loaded coupling which permits it to be removed from or slide across the body to quickly release the tension of the strings and permit easy uncoupling of the neck from the body. Accordingly, it is a appropriate that the appended claims be construed broadly and in a manner consistent with the spirit and scope of the invention.

What I claim is:

1. A collapsible stringed musical instrument comprising:

an elongated body having a coupling portion at one end, a string bridge portion at the other end, and having a playing face and an opposite back face;

a neck having a coupling portion at one end and a string peg portion at the other end, said coupling portion of said neck being adapted to mate with said coupling portion of said elongated body;

a plurality of body simulating supports pivotably affixed at one end to said back face of said elongated body, said supports being pivotable about an axis substantially normal to said back face from a closed position in which they are situated within the outline of said elongated body to an open position in which they substantially extend beyond said outline.

2. A collapsible stringed musical instrument as claimed in claim 1 wherein:

each of said supports has a radial arm portion and a brace portion, said brace portion being remote from said one end of said support.

3. A collapsible stringed musical instrument as claimed in claim 2 wherein:

said brace portion of at least one of said supports has a concave arched surface.

4. A collapsible stringed musical instrument as claimed in claim 2 wherein:

said brace portion of at least one of said supports has a convex arched surface.

5. A collapsible stringed musical instrument as claimed in claim 1, wherein:

said supports have lock washer means for selectively positioning said supports in an open position.

6. A collapsible stringed musical instrument as claimed in Claim 1 wherein:

said supports are capable of comfortably supporting a user's arm, comfortably resting on the user's chest, and comfortably allowing placement on either of the user's legs.

7. A collapsible stringed musical instrument comprising:

an elongated body having a coupling portion at one end, a string bridge portion at the other end, and having a playing face and an opposite back face;

a plurality of body simulating supports pivotably affixed at one end to said back face of said elongated body such that said supports are capable of supporting a user's arm, resting on the user's chest, and allowing placement on either of the user's legs, said supports being pivotable about an axis substantially normal to said back face between a closed position in which they are situated within the outline of said elongated body, and an open position in which they extend substantially beyond said outline; and a neck having a coupling portion at one end and a string peg portion at the other end, said coupling portion of said neck being adapted to mate with said coupling portion of said elongated body;

said neck having length and width dimensions such that said neck is capable of being situated substantially within the outline of said elongated body when said supports are in said closed position.

* * * * *